US007306478B2

(12) United States Patent
Kudo et al.

(10) Patent No.: US 7,306,478 B2
(45) Date of Patent: Dec. 11, 2007

(54) CONNECTOR IMPROVED IN DUST TIGHTNESS

(75) Inventors: Takaaki Kudo, Tokyo (JP); Naofumi Ikenaga, Tokyo (JP)

(73) Assignee: Japan Aviation Electronics, Industry, Limited, Tokyo (JP)

( * ) Notice: Subject to any disclaimer, the term of this patent is extended or adjusted under 35 U.S.C. 154(b) by 0 days.

(21) Appl. No.: 11/588,167

(22) Filed: Oct. 26, 2006

(65) Prior Publication Data

US 2007/0093122 A1 Apr. 26, 2007

(30) Foreign Application Priority Data

Oct. 26, 2005 (JP) ..... 2005-311381

(51) Int. Cl.
*H01R 12/24* (2006.01)

(52) U.S. Cl. ..... 439/494

(58) Field of Classification Search ..... 439/260, 439/494, 495, 496

See application file for complete search history.

(56) References Cited

U.S. PATENT DOCUMENTS 5,906,498 A 5/1999 Nagafuji
6,089,905 A * 7/2000 Shimmyo et al. ..... 439/495
6,669,503 B2 * 12/2003 Hirose ..... 439/495
7,029,319 B2 * 4/2006 Kunishi ..... 439/492
7,044,773 B2 5/2006 Suzuki et al.
7,179,118 B1 * 2/2007 Harlan et al. ..... 439/495
2007/0155213 A1 * 7/2007 Shin ..... 439/260

FOREIGN PATENT DOCUMENTS

JP 10208810 8/1998
JP 11307198 11/1999
JP 2002270290 9/2002
JP 2004178958 6/2004
JP 2004206987 7/2004
JP 2004-342426 12/2004
JP 2005243390 9/2005

* cited by examiner

*Primary Examiner*—Chandrika Prasad
(74) *Attorney, Agent, or Firm*—Collard & Roe, P.C.

(57) ABSTRACT

In a connector provided with a main body including a plurality of contacts arranged in parallel in a first direction and a housing holding the contacts, an operating member is coupled to the main body and is rotatable between an open position at which a connection object is allowed to be inserted into the main body and a closed position at which the contacts are contacted to the connection object. The operating member has a rib inserted between adjacent ones of the contacts and a recessed portion adjacent to the rib in a rotating direction. The housing has a protruding portion to be inserted into the recessed portion when the operating member is at the open position. The rib at least partially approaches the protruding portion when the operating member is at the closed position.

9 Claims, 5 Drawing Sheets

CONNECTOR IMPROVED IN DUST TIGHTNESS

This application claims priority to prior Japanese patent application JP 2005-311381, the disclosure of which is incorporated herein by reference.

BACKGROUND OF THE INVENTION

This invention relates to a connector for connecting a connection object such as a FPC (Flexible Printed Circuit).

Japanese Unexamined Patent Application Publication (JP-A) No. H10-208810 discloses a small-sized connector capable of connecting a FPC or a FFC (Flexible Flat Cable) with high operability while preventing misaligned connection. Japanese Unexamined Patent Application Publication (JP-A) No. H11-307198 discloses a connector for collectively connecting a plurality of terminals of a FPC and holding the FPC with improved operability and holdability. Japanese Unexamined Patent Application Publication (JP-A) No. 2002-270290 discloses a low-profile connector capable of operating an actuator as an operating member with small operating force and of increasing a moving distance of a contact driven by the actuator so as to achieve reliable connection. Japanese Unexamined Patent Application Publication (JP-A) No. 2004-178958 discloses a small-sized connector capable of reliably guiding a FPC or a FFC into a fitting opening and of reducing a pitch. Japanese Unexamined Patent Application Publication (JP-A) No. 2004-206987 discloses a connector adaptable to reduction in pitch and to a FPC having contacting portions on opposite surfaces. Japanese Unexamined Patent Application Publication (JP-A) No. 2004-342426 discloses a connector small in outer dimension and capable of preventing removal of a rotating member and a contact without providing a stopper or the like.

In each of the above-mentioned connectors, a contact (terminal) has a first part on one side to be connected to a connection object such as a FPC and a second part on the opposite side to be operated by an operating member. When the connection object is fitted and connected to the connector, the first part of the contact or terminal is covered by the connection object and protected. On the other hand, the second part of the contact or terminal is exposed outside or, even if it is partially covered by a housing or the like, has air permeability due to its structure. Therefore, the second part of the contact is often contaminated by external foreign matters such as grit and dust attached thereto. Depending upon a use environment, various troubles, such as short-circuiting, migration, and corrosion of a terminal portion of the contact or terminal, may be caused to occur.

For example, Japanese Unexamined Patent Application Publication (JP-A) No. 2005-243390 discloses a connector capable of preventing occurrence of short-circuiting, migration, and corrosion of a terminal portion of a contact due to foreign matters such as grit and dust. In the connector, an operating member has a cover portion which covers a part of the contact in order to avoid the above-mentioned troubles. However, the connector has a structure in which a plurality of contacts same in shape are simply arranged in parallel and, therefore, is hardly adaptable to a connection object having a complicated wiring pattern of a wide variety of designs, including a reduction in pitch in a signal wiring pattern.

SUMMARY OF THE INVENTION

It is therefore an object of this invention to provide a connector which is capable of withstanding a use environment where the connector is exposed to grit and dust.

Other objects of the present invention will become clear as the description proceeds.

According to an aspect of the present invention, there is provided a connector to be connected to a connection object. The connector comprises a main body including a plurality of contacts arranged in parallel in a first direction and a housing holding the contacts, and an operating member coupled to the main body and rotatable between an open position at which the connection object is allowed to be inserted into the main body and a closed position at which the contacts are contacted to the connection object. The operating member includes a rib inserted between adjacent ones of the contacts and a recessed portion adjacent to the rib in a rotating direction. The housing has a protruding portion to be inserted into the recessed portion when the operating member is at the open position. The rib at least partially approaches the protruding portion when the operating member is at the closed position.

DESCRIPTION OF THE PREFERRED EMBODIMENT

Figure 1:
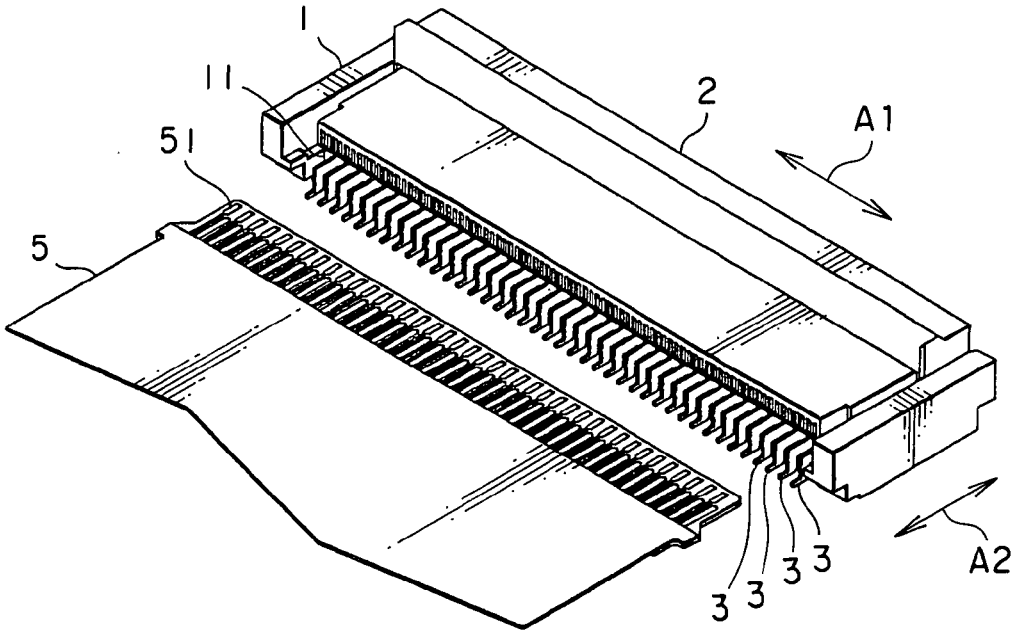
FIG. 1 is a perspective view of a connector according to an embodiment of this invention together with a connection object.
Figure 2:
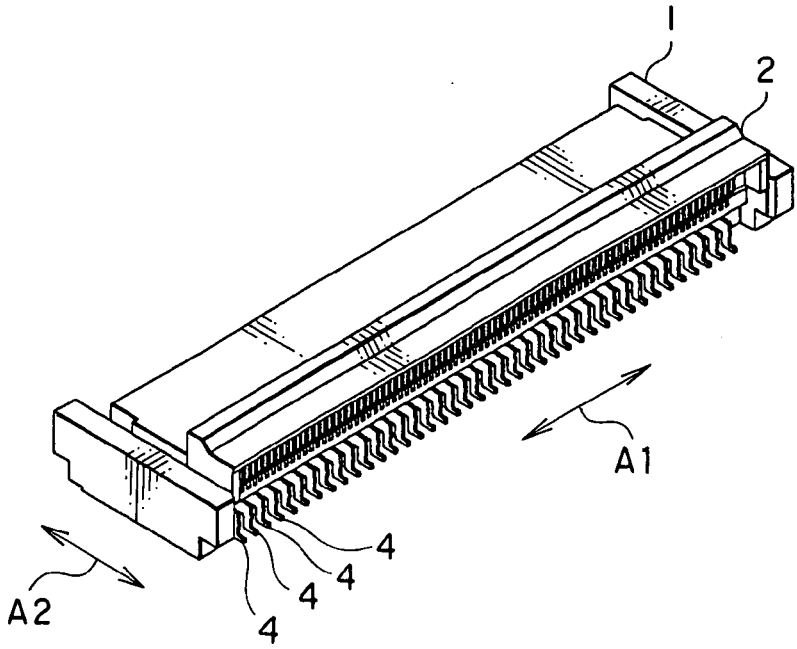
FIG. 2 is a perspective view of the connector in FIG. 1 as seen in a different direction.

Referring to FIGS. 1 and 2, description will be made of a connector according to an embodiment of this invention.

The connector illustrated in the figure is adapted to be mounted to a printed circuit board or the like and comprises a housing 1 and an operating member (actuator) 2 each of which is made of an insulating material. The housing 1 holds a number of conductive first and second contacts 3 and 4 alternately arranged in parallel in a first direction (transversal direction) A1. Each of the contacts 3 and 4 has a thin plate-like shape small in dimension in the first direction A1. A FPC 5 as a connection object is inserted into and removed from a fitting opening 11 of the housing 1 in a second direction (back-and-forth direction) A2 perpendicular to the first direction A1. Herein, one side and the other side of the connector relatively near to the fitting opening 11 and relatively distant from the fitting opening 11 will be called an insertion side and the opposite side, respectively.

A combination of the housing 1 and the contacts 3 and 4 will be called a main body. The operating member 2 is coupled to the opposite side of the main body and, by a structure which will later be described in detail, is rotatable between an open position at which the FPC 5 is allowed to be inserted and removed and a closed position at which contacts 3 and 4 are contacted with the FPC 5. Thus, the operating member 2 is rotatable with respect to a center axis extending in the first direction A1. The FPC 5 has a number of pads 51 formed at its one end in correspondence to the contacts 3 and 4.

Figure 3:
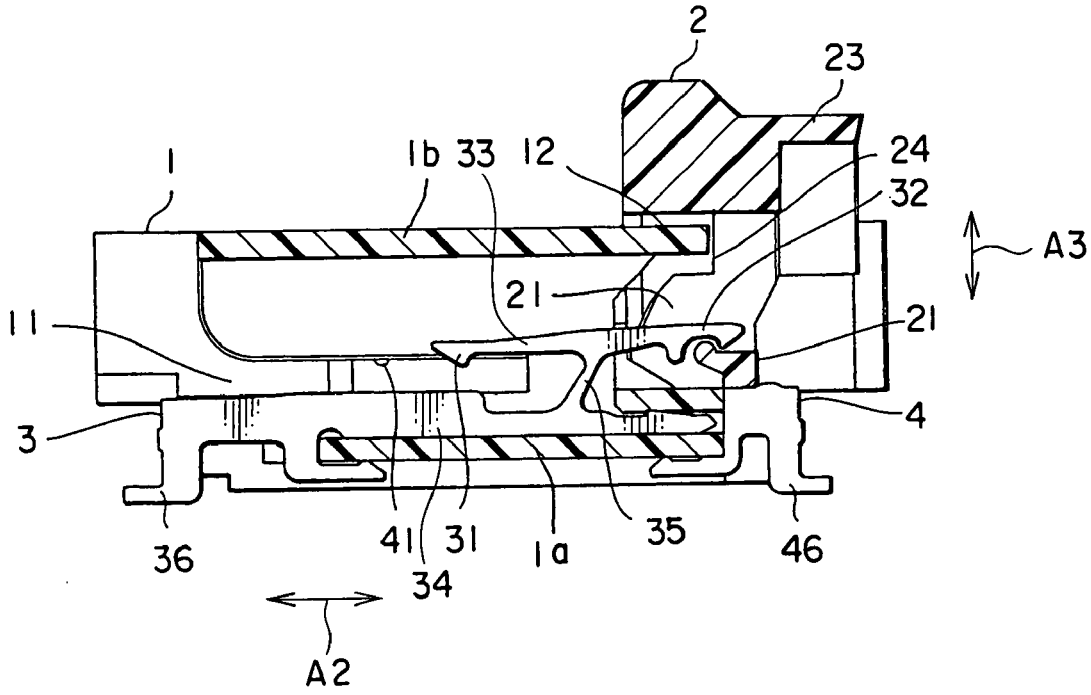
FIG. 3 is a sectional view of the connector in FIG. 1.
Figure 4:
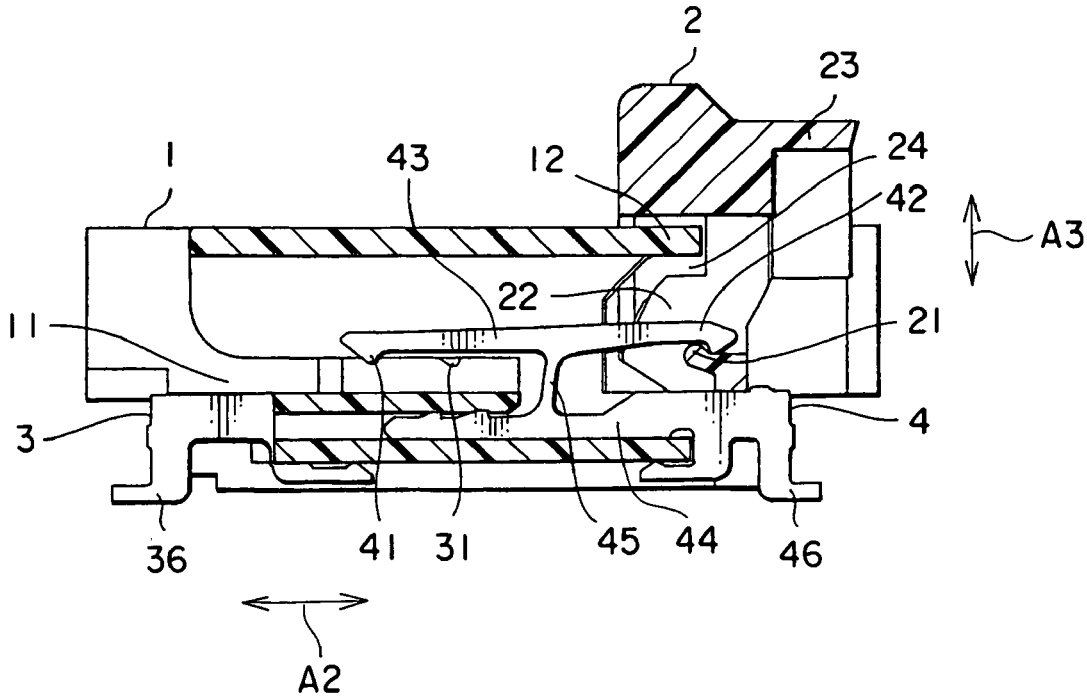
FIG. 4 is a sectional view of the connector in FIG. 1, taken at a position different from that in FIG. 3.
Figure 5:
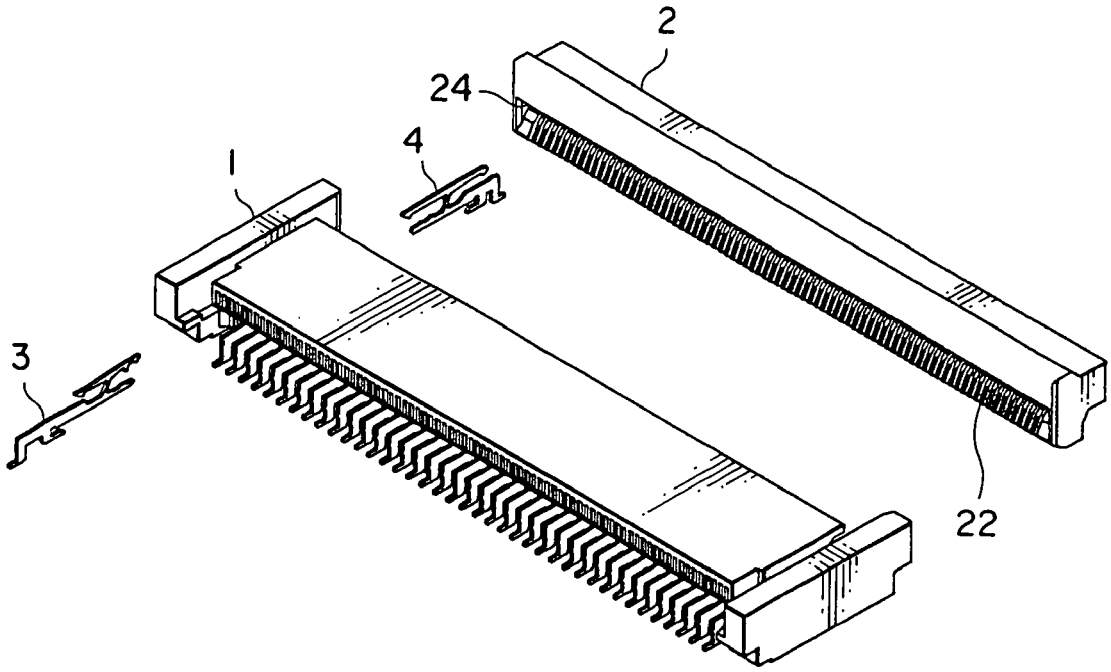
FIG. 5 is an exploded perspective view of the connector in FIG. 1.
Figure 6:
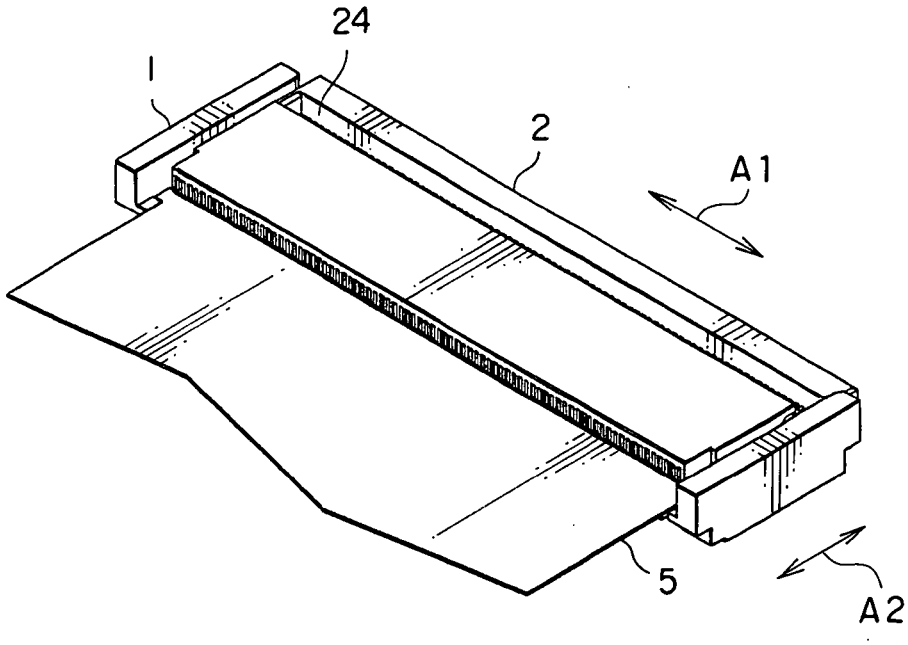
FIG. 6 is a perspective view of the connector in FIG. 1 when a connection object is connected thereto.
Figure 7:
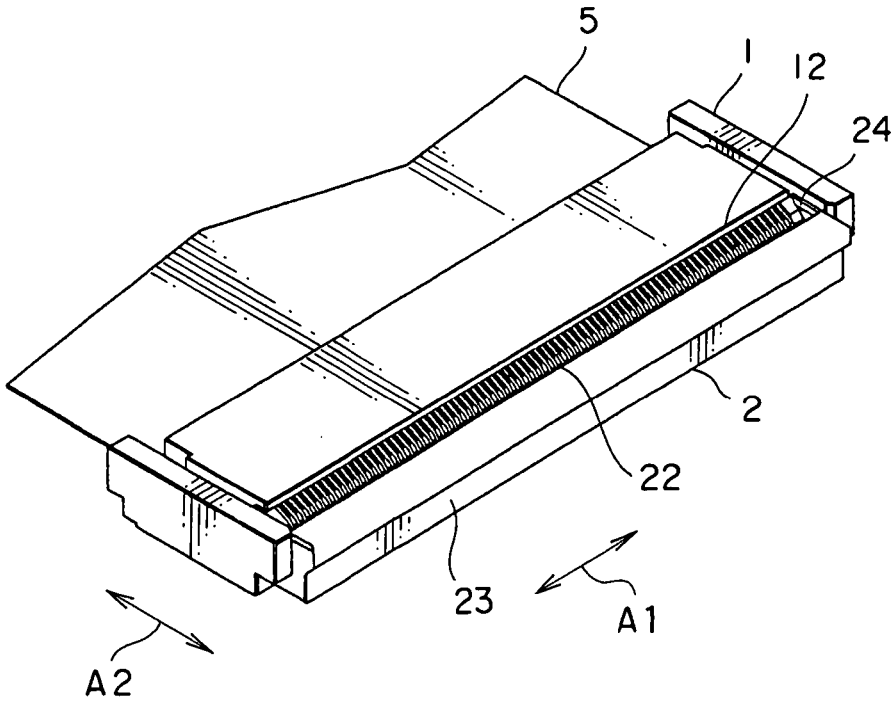
FIG. 7 is a perspective view of the connector in the state in FIG. 6 as seen in a different direction.
Figure 8:
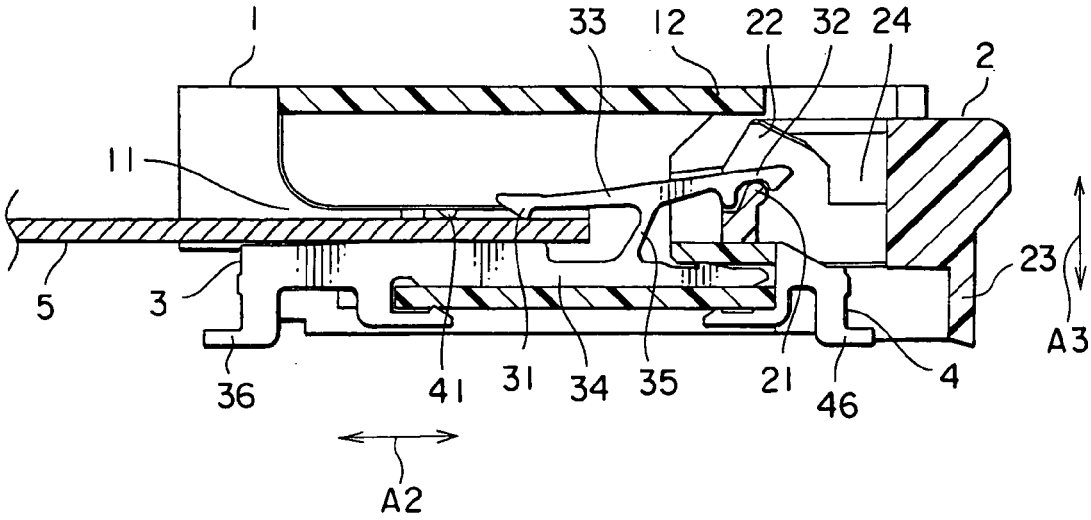
FIG. 8 is a sectional view of the connector in the state in FIG. 6.
Figure 9:
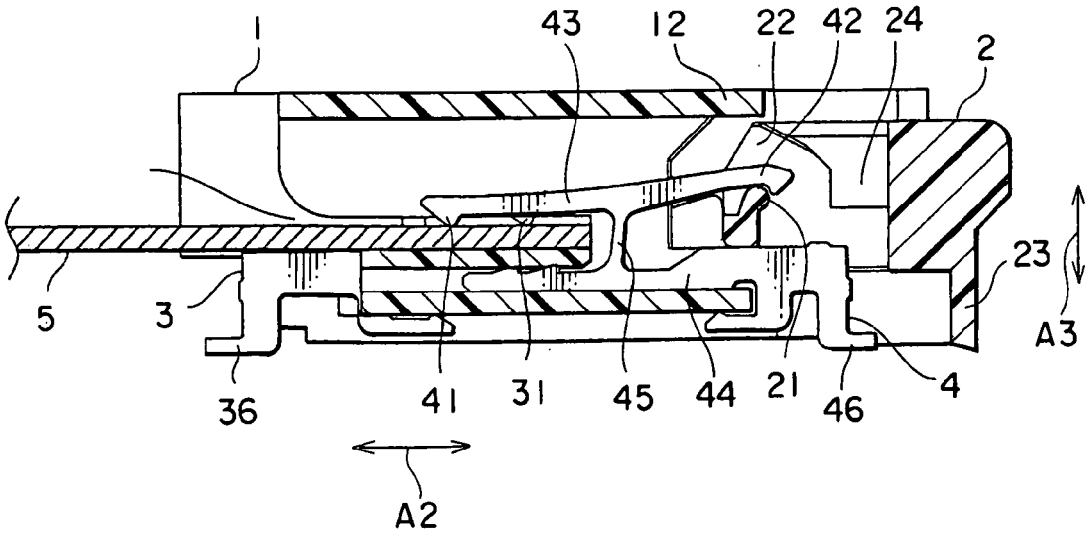
FIG. 9 is a sectional view of the connector in the state in FIG. 6, taken at a position different from that in FIG. 8.

Referring to FIGS. 3 to 5, description will be made of details of the connector in the state where the FPC 5 is not connected.

The operating member 2 has a rotation locking portion 21 serving as a cam portion, a number of plate-like ribs 22 disposed around the rotation locking portion 21 and each extending in a plane perpendicular to the first direction A1, a cover portion 23 disposed radially outward from the ribs 22 and extending long in the first direction A1 over an entire length of the operating member 2, and a recessed portion 24 adjacent to the ribs 22 in a rotating direction of the operating member 2 and extending in the first direction A1 over the entire length of the operating member 2. The ribs 22 are inserted between adjacent ones of the contacts 3 and 4. A gap between each of the ribs 22 and each of the contacts 3 and 4 is designed small.

The housing 1 has a bottom wall 1*a* holding the contacts 3 and 4, and a top wall 1*b* faced to and spaced from the bottom wall 1*a* in a third direction (vertical direction) A3 perpendicular to the first and the second directions A1 and A2. The top wall 1*b* has a plate-like protruding portion 12 extending rearward and inserted to the recessed portion 24 of the operating member 2 which is at the open position as illustrated in FIGS. 3 and 4. The protruding portion 12 extends in the first direction A1 over a substantially entire length of the housing 1. Since the plate-like protruding portion 12 is inserted into the recessed portion 24 of the operating member 2, it is possible to prevent grit or dust from entering into the housing 1.

As will later become clear, when the operating member 2 is moved to the closed position, the recessed portion 24 is released from the protruding portion 12. In this event, the ribs 22 at least partially approach a lower surface of the protruding portion 12. Therefore, it is possible to prevent grit or dust from entering into the housing 1.

Each of the first contacts 3 has a contacting portion 31 formed on the insertion side and adapted to be contacted with the FPC 5, a pivot portion 32 formed on the opposite side, a seesaw portion 33 connecting the contacting portion 31 and the pivot portion 32, a holding portion 34 held by the housing 1, a connecting portion 35 having elasticity and connecting the seesaw portion 33 to the holding portion 34, and a terminal portion 36 formed on the insertion side of the holding portion 34. The seesaw portion 33 is adapted to perform seesaw movement with respect to the holding portion 34 as a support point.

Each of the second contacts 4 has a contacting portion 41 formed on the insertion side and adapted to be contacted with the FPC 5, a pivot portion 42 formed on the opposite side, a seesaw portion 43 connecting the contacting portion 41 and the pivot portion 42, a holding portion 44 held by the housing 1, a connecting portion 45 having elasticity and connecting the seesaw portion 43 to the holding portion 44, and a terminal portion 46 formed on the insertion side of the holding portion 44. The seesaw portion 43 is adapted to perform seesaw movement with respect to the holding portion 44 as a support point.

The rotation locking portion 21 of the operating member 2 is clamped or interposed between each of the pivot portions 32 and 42 and the holding portion 44 in the third direction A3 and engaged with the pivot portions 32 and 42 in the second direction A2. Thus, the operating member 2 is rotatable around the pivot portions 32 and 42. The terminal portions 34 and 44 are fixed to the printed circuit board, for example, by soldering. The first and the second contacts 3 and 4 are different from each other in position of the terminal portions 34 and 44 and, therefore, are fixed to the housing 1 from opposite sides in the second direction A2.

As is apparent from comparison between FIGS. 3 and 4, the contacting portions 41 of the second contacts 4 are arranged nearer to the insertion side than the contacting portions 3 of the first contacts 3. Consequently, the contacting portions 31 and 41 are arranged in parallel in a staggered pattern in the first direction A1.

Next referring to FIGS. 6 to 9, description will be made of a case where the FPC 5 is connected to the connector.

At first, the FPC 5 is inserted from an inlet side into the fitting opening 11 of the housing 1. Thereafter, the operating member 2 is rotated to the closed position. Following the rotation of the operating member 2, the rotation locking portion 21 acts as a cam portion to lift the pivot portions 32 and 42 upward. As a consequence, the seesaw portions 33 and 43 perform seesaw movement with respect to the holding portions 34 and 44 to bring the contacting portions 31 and 41 into press contact with the pads 51 of the FPC 5. Thus, the FPC 5 is connected to the connector.

At this time, the recessed portion 24 of the operating member 2 is rotated and displaced away from the protruding portion 12 of the housing 1. Consequently, the cover portion 23 covers the terminal portions 46 of the second contacts 4. Simultaneously, the ribs 22 arranged between adjacent ones of the first and the second contacts 3 and 4 as described above at least partially approach the lower surface of the protruding portion 12 of the housing 1. Thus, even in a use environment where the connector is exposed to grit and dust, the contacts 3 and 4 are sufficiently protected so as to stably maintain electric conductivity.

After is brought into contact with the pivot portions 32 and 42, the rotation locking portion 21 is engaged with end wall portions of the pivot portions 32 and 42 with sliding along bottoms of the pivot portions 32 and 42 in the second direction A2. In this event, the pivot portions 32 and 42 are pushed upwardly by rotation locking portion 21. As a consequence, the rotation locking portion 21 is pushed downwardly by restoring force of the first and the second contacts 3 and 4. The restring force serves to rotate the operating member 2 in a clockwise direction of FIGS. 8 and 9. Therefore, the operating member 2 stops at the closed position to assure stability of connection of the FPC 5.

Although this invention has been described in conjunction with the preferred embodiment thereof, this invention may be modified in various other manners within the scope of the appended claims. For example, in a case where only two contacts are used in the connector, the operating member may be designed to have a single rib inserted between the two contacts.

What is claimed is:

1. A connector to be connected to a connection object, the connector comprising:

a main body including a plurality of contacts arranged in parallel in a first direction and a housing holding the contacts; and an operating member coupled to the main body and rotatable between an open position at which the connection object is allowed to be inserted into the main body and a closed position at which the contacts are contacted to the connection object;

the operating member including:

a rib inserted between adjacent ones of the contacts; and a recessed portion adjacent to the rib in a rotating direction;

the housing having a protruding portion to be inserted into the recessed portion when the operating member is at the open position;

the rib at least partially approaching the protruding portion when the operating member is at the closed position.

2. The connector according to claim 1, wherein the operating portion is rotatable with respect to a center axis extending in the first direction.

3. The connector according to claim 2, wherein the recessed portion extends in the first direction.

4. The connector according to claim 1, wherein:

the connection object is adapted to be inserted into the main body in a second direction perpendicular to the first direction;

each of the contacts having:

a contacting portion formed on an insertion side in the second direction and adapted to be contacted with the connection object; and a pivot portion formed on an opposite side opposite to the insertion side in the second direction;

the operating member having a rotation locking portion rotatably locked by the pivot portion.

5. The connector according to claim 4, wherein each of the contacts has:

a seesaw portion connecting the contacting portion and the rotation locking portion;

a holding portion held by the housing; and a connecting portion having elasticity and connecting the seesaw portion to the holding portion;

the seesaw portion being adapted to perform seesaw movement with respect to the holding portion as a support point.

6. The connector according to claim 5, wherein the contacts includes:

a first contact in which the holding portion has a terminal portion on the insertion side; and a second contact in which the holding portion has a terminal portion on the opposite side;

the first and the second contacts being arranged in the first direction.

7. The connector according to claim 6, wherein the contacting portion of the second contact is disposed at a first position of the insertion side while the contacting portion of the first contact is disposed at a second position of the insertion side, the second position being disposed from the first position towards the opposite side.

8. The connector according to claim 6, wherein the operating member is disposed on the opposite side with respect to the main body and has a cover portion which covers the terminal portion of the second contact when the operating member is at the closed position.

9. The connector according to claim 5, wherein the rotation locking portion is clamped between the holding portion and the pivot portion and is locked to the pivot portion in the second direction.

* * * * *